US005349977A

United States Patent [19]

Wood

[11] Patent Number: 5,349,977

[45] Date of Patent: Sep. 27, 1994

[54] ADJUSTABLE WALKER

[76] Inventor: Maurice S. Wood, 15318 Chipman, Houston, Tex. 77060

[21] Appl. No.: 680,843

[22] Filed: Apr. 5, 1991

[51] Int. Cl.[5] ..... A61H 3/00

[52] U.S. Cl. ..... 135/67; 135/69; 297/5; 248/410; 403/104; 403/109

[58] Field of Search ..... 135/67, 69, 70; 297/5, 297/345; 248/410, 188.5, 188.8; 403/104, 109, 107, 377

[56] References Cited

U.S. PATENT DOCUMENTS

| | | | |
|---|---|---|---|
| 1,372,456 | 3/1921 | Roetter | 248/410 |
| 2,090,550 | 8/1937 | Pilblad | 248/410 |
| 2,849,204 | 8/1958 | Petrick et al. | 248/410 |
| 3,176,700 | 4/1965 | Drury, Jr. | 135/69 X |
| 3,387,617 | 6/1968 | Reiber | 135/67 |
| 3,421,529 | 1/1969 | Vestal | 135/67 |
| 3,734,441 | 5/1973 | Lux | 248/410 X |
| 3,800,815 | 4/1974 | Birk | 135/67 |
| 4,411,283 | 10/1983 | Lucarelli | 135/67 |
| 4,777,973 | 10/1988 | Nakajima | 135/67 |
| 4,830,035 | 5/1989 | Liu . | |

FOREIGN PATENT DOCUMENTS

| | | | |
|---|---|---|---|
| 4761 | 10/1979 | European Pat. Off. | 135/69 |

*Primary Examiner*—David A. Scherbel
*Assistant Examiner*—Lan Mai
*Attorney, Agent, or Firm*—Harrison & Egbert

[57] ABSTRACT

The present invention relates to invalid walkers which are designed to aid the handicapped. Specifically, the present invention relates to an attachment to an existing walker, or a modified existing walker which is hand operated and designed to be made adjustable to accommodate inclines or stairs. This walking aid will enable persons using it to ascend and descend stairs and inclines much easier.

18 Claims, 6 Drawing Sheets

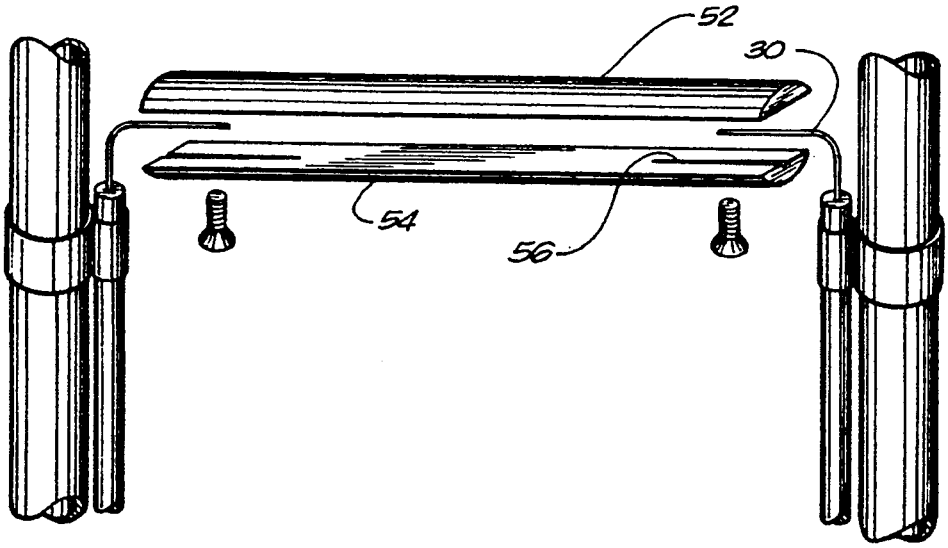
FIG. 5
FIG. 6
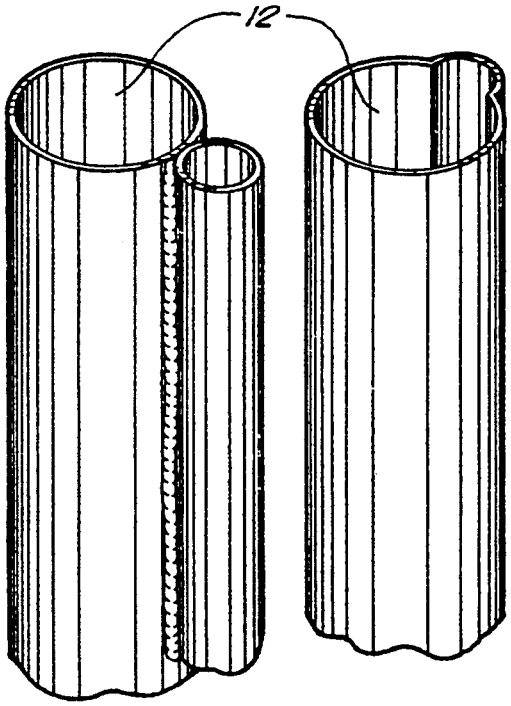

ADJUSTABLE WALKER

BACKGROUND OF THE INVENTION

1. Field of the Invention

The present invention relates to invalid walkers which are designed to aid the handicapped.

2. Description of the Prior Art

During a preliminary prior art search, the following references were cited.

U.S. Pat. No. 3,176,700, Drury, Jr. discloses a walking aid device which comprises spring loaded adjustable rear legs.

U.S. Pat. No. 3,387,617, Reiber discloses an adjustable leg invalid walker with telescoping front legs.

U.S. Pat. No. 3,800,815, Birk discloses an invalid walker with telescoping front and rear legs using hydraulic fluid lines.

U.S. Pat. No. 4,411,283, Lucarelli discloses a walker with a telescoping front leg assembly.

U.S. Pat. No. 4,777,973, Nakajima discloses a walker with extensible/contractable front and rear legs.

U.S. Pat. No. 4,830,035, Liu discloses an adjustable walker using seesaw controllers.

The present invention has two major advantages not found in the prior art. One advantage is a unique hand actuator means; the other being that the present invention may be an attachment to a walker rather than an improved walker.

Prior art references are found to be complex and expensive to manufacture as well as being limited in maneuverability. Further, none of the prior art references took into consideration the problem of persons with arthritis or other hand limitations. The present invention may be used by even individuals with severe arthritis. The actuator may be engaged by using the wrist or even the outer portion of the thumb.

SUMMARY OF THE INVENTION

The present invention as disclosed, may be sold as a "kit" which would contain four supplemental legs, two actuator bars and mechanical means for attaching the "kit" to an existing walker. Once attached, the actuator bars, which are positioned below the primary handles of the walker, are designed to be within reasonable finger span of practically any individual. The actuator bars are engaged by pulling upward slightly. This motion engages the housing assembly located near the bottom of the original legs of the walker and releases the supplemental legs individually. Gravity allows the supplemental legs to drop to whatever level necessary. Once the supplemental legs are positioned, the walker will remain in that position until the user engages the actuator bars again.

The actuator bars are designed for persons with limited physical and mental faculties in that the top of the actuator bars extend the full width between the side frames of the walker. The user does not have to make eye contact with the actuator bars to engage them. Simply extending the fingers outward will allow the user to feel the actuator bars and engage them.

When in position, the more weight applied to the apparatus, the stronger the hold will become.

When a user approaches stairs that descend, the walker should be positioned with the front legs suspended over the first actual step with the rear legs resting on the landing. The actuator bars are engaged, the front legs, by gravity will drop to the first step with the rear legs remaining in place. The actuator bars are released and the user may securely descend the stairs. The adjustable walker attachment is designed to accommodate most available walkers.

During testing, it was found that some individuals using a walker while attempting to descend stairs, became frightened while going "head first" down a flight of stairs. The present invention is designed with supplemental extensible legs of such length to allow the user to position the walker sideways; allowing the outermost legs to fall onto the next or third step once activated. Because of the varying widths of walkers, some walkers, when turned sideways will not fit on consecutive steps. In this case, the walker is positioned with a front and rear leg on one step with the remaining front and rear legs being allowed to drop onto the third step.

Further observation and study has shown that older people tend to reach up for security or a holding position rather than reaching down. Using the walker sideways will allow the user to feel more secure, by having the handles higher than normal and further could allow the user to place their back against the stair wall or banister to aid in guiding them securely down the stairs. Granted, severely handicapped or elderly persons will not be traveling up and down great amounts of stairs, but the present invention will be a definite asset when any uneven terrain or stairs are encountered.

Great care has been taken in developing this attachment so that it will add only a minimum amount of weight to the existing walker. Since people requiring walkers usually are not physically strong, any additional amount of weight is an unnecessary obstacle. The same configuration may be developed into a walker with the mechanics of the present invention located inside the walker. The actuator bars and perhaps the housing assembly will be the only visual indication that the walker is adjustable for stairs or other inclines.

An object of the present invention is to provide an improved walking aid.

Another object of the present invention is to provide an economical means of converting a walker into an adjustable walking aid.

Yet another object of the present invention is to provide a means of engaging an adjustable walker with a minimum of movement.

DETAILED DESCRIPTION OF THE PREFERRED EMBODIMENT

Figure 1:
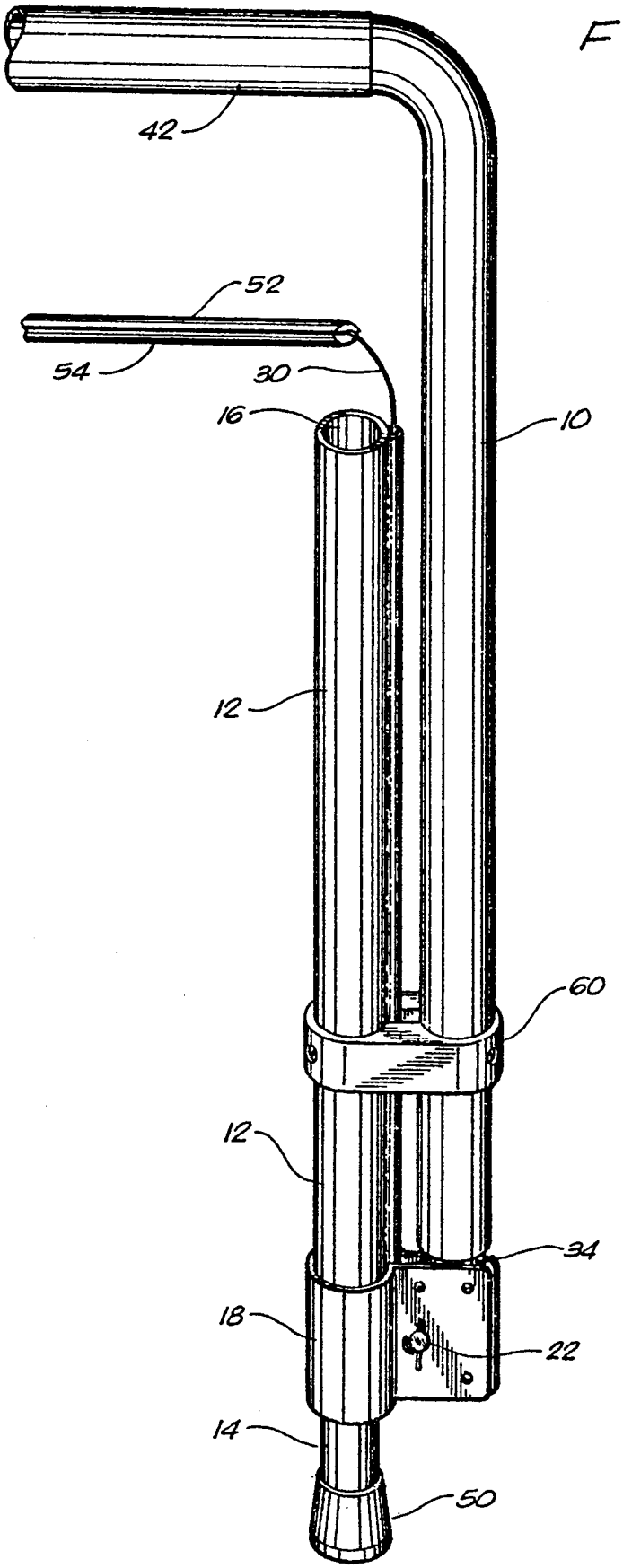
FIG. 1 is a perspective view of a first embodiment of a walker attachment used in combination with a walker in accordance with the invention.

Referring to FIG. 1, the present invention is shown in combination with a standard walker 10. Actuating means which consists of two actuator bars 12 and 14 which are preferably inverted U-shaped members, are secured along each side frame of the walker 10 by clamps or conforming bands 16 which may be made of plastic or metal. The actuator bars 12 and 14 are virtually the same length and shape as the side frame of the walker 10; however the top of the actuator bars 12 and 14 are placed subordinate to the hand grips 22. The actuator bars 12 and 14 are positioned such that they are within hand span of the user when the users hands are placed in normal position along the hand grips 22 of the walker 10.

The actuator bars 12 and 14 are small enough in diameter so as to easily fit into the housing assembly 40 of the present invention. The actuator bars 12 and 14 are made of light weight durable, rigid material and may be coated or covered in plastic.

Figure 2:
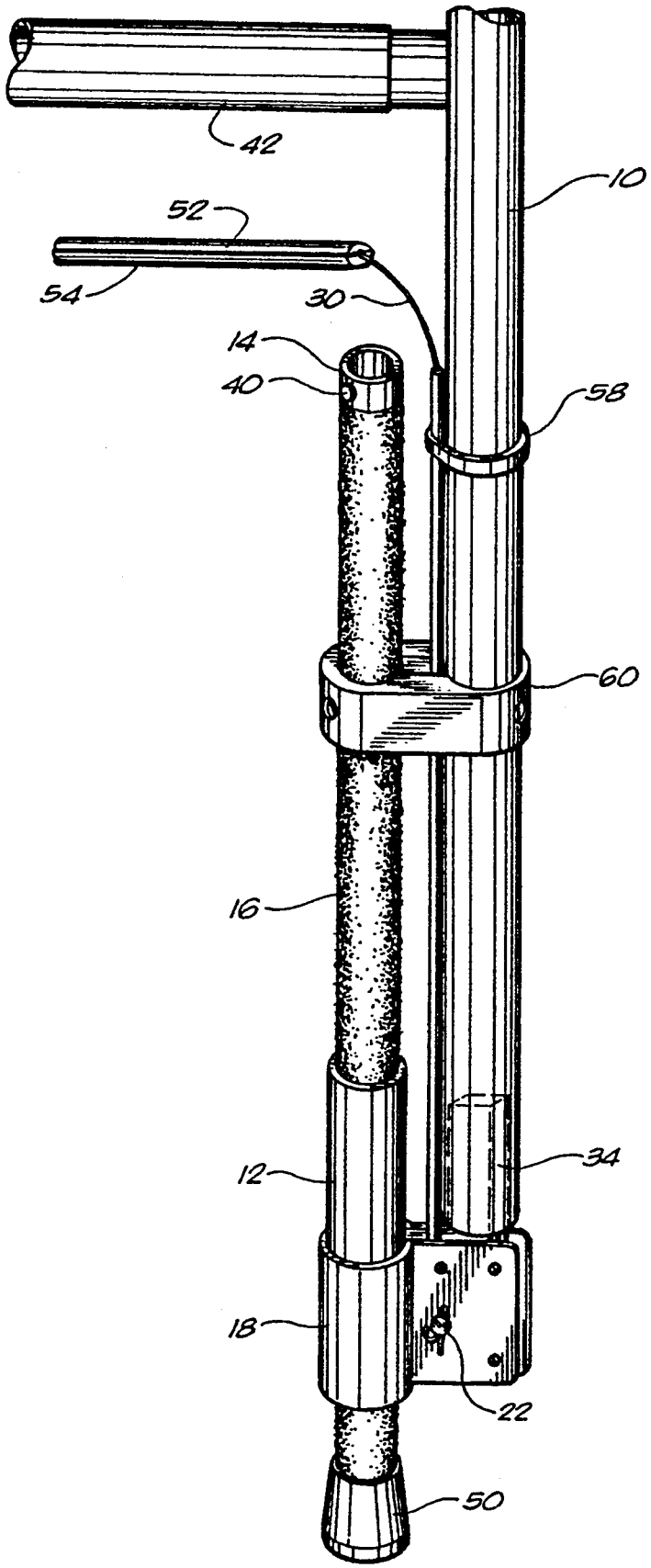
FIG. 2 is a side view of a preferred housing assembly as attached to a supplemental leg useful in the embodiment of FIG. 1.
Figure 3:
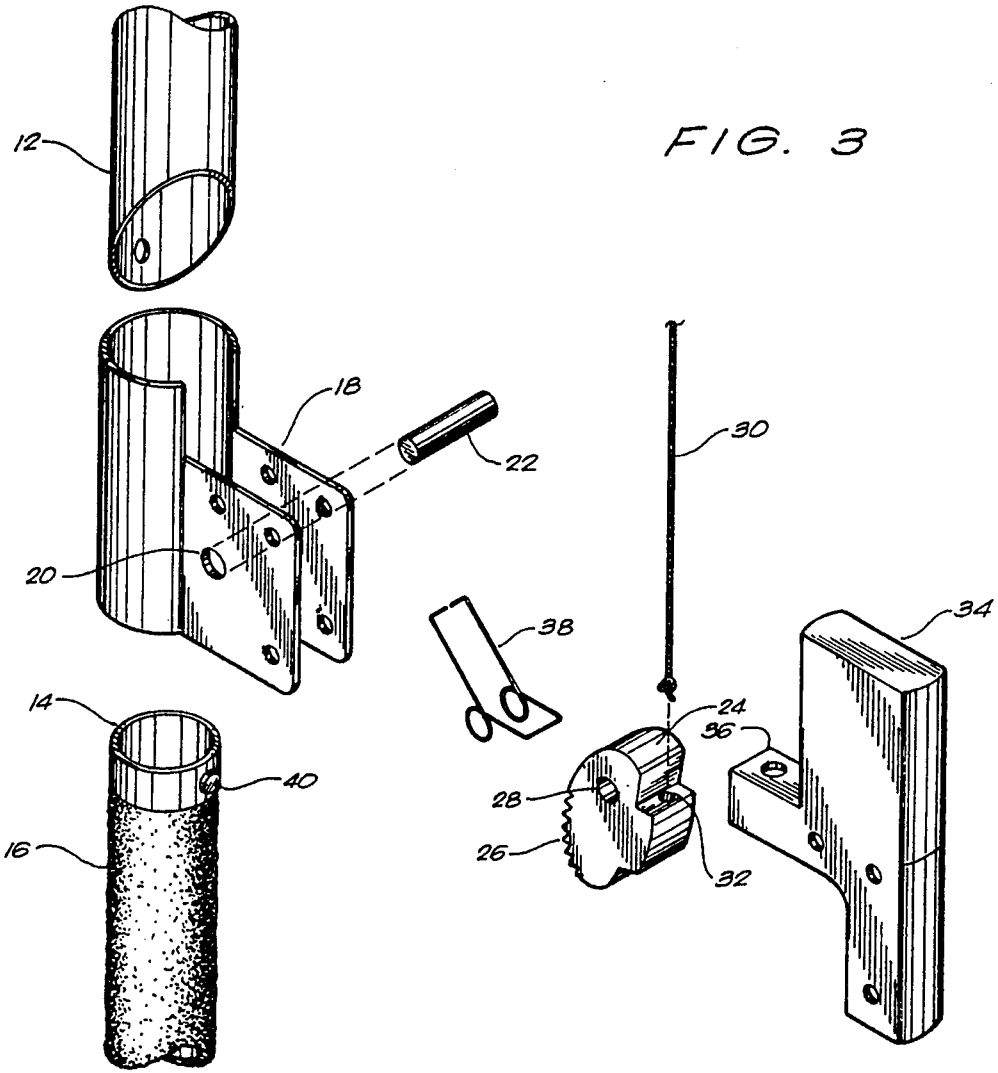
FIG. 3 is an exploded view of a preferred housing assembly and supplemental leg useful in the embodiment of FIG. 1.
Figure 4:
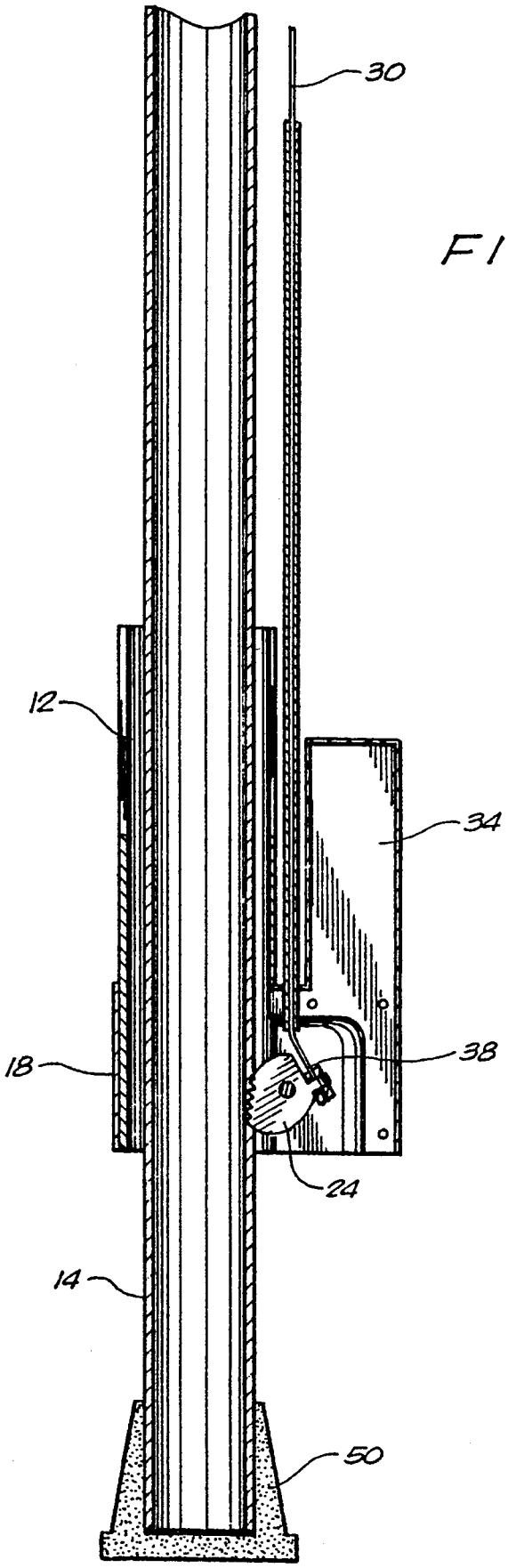
FIG. 4 is a fragmentary side view of an actuator bar as attached to the housing assembly in accordance with the invention.

Referring to FIGS. 2 and 3, the housing assembly 40 is shown in more detail. FIG. 2 illustrates one supplemental extensible leg 24 having a non-skid cap 18 on one end and the housing assembly 40 on the opposite end. The housing assembly 40 comprising a housing apparatus 20 which is preferably a light weight, hollow cast, machined or molded cylindrical sleeve open on either end. The housing apparatus 20 having a recognizable bottom half 46 and top half 48. Recognizable in that the bottom half 46 is somewhat larger in diameter than the upper half 48; defining a shoulder 35; with the bottom half 46 including a wide T-Shaped opening 28 positioned along one side of the bottom half 46; the wide T-shaped opening 28 designed to receive a tabbed ring 32. The upper half 48 of the housing apparatus 20 having a plurality of longitudinal slits 50 which give it flexibility and allow it to be easily slipped onto the original frame 52 of the walker and then secured to the original frame 52 of the walker by compressing or tightening the longitudinal slits 50

At least one tabbed ring 32 including an opening 44 of such diameter to receive a supplemental leg 24 is placed horizontally into the housing apparatus 20. Each tab 34 of each tabbed ring 32 further includes an opening 54 of such size so as to receive a free end of the actuator bar 12 or 14. The tabbed ring 32 is inserted into the wide T-shaped opening 28 located in the bottom half 46 of the housing apparatus 20 and allowing the tab 34 of the tabbed ring 32 to extend outward from the housing apparatus 20. The tabbed ring 32 further positioned horizontally so that the tab 32 rests on the bottom ledge of the wide T-shaped opening 28 of the housing apparatus 20. A coiled spring 38 is dropped into the upper half 48 of the housing apparatus 20 and onto the top of the tabbed ring 32. The coiled spring 38 is provided to allow compression of the tabbed ring 32 when the housing assembly 20 is engaged. A C-shaped clamp 26 somewhat resembling a hose clamp is then placed onto the upper half 48 of the housing apparatus 20; the C-shaped clamp 26 rests upon the shoulder 35 as shown in FIG. 3. The C-shaped clamp 26 includes a screw and nut combination 30 which is used to tighten the C-shaped clamp 26.

The supplemental leg 24 includes stopping means so that it will not fall out of the walker frame 52 once it is in place. Stopping means may be a washer 56 fitted to the uppermost part of the supplemental leg 24 and is somewhat larger in diameter than the diameter of the supplemental leg 24; or may be some other means of preventing the supplemental leg 24 from falling from the walker frame 52.

The supplemental leg 24 is slidably placed into the bottom of the housing assembly 40, through the tabbed ring 32, and rests just above the top of the housing apparatus 20.

The entire assembly is then slidably placed on the original frame 52 of the walker 10 and tightened by the screw and nut combination 30 on the C-shaped clamp The free ends of the actuator bars 12 and 14 are placed in the openings 54 located in the tabs 34 of the tabbed rings The free ends of the actuator bars 12 and 14 are crimped or deformed in a way so that they will not become dislodged from the tabbed rings 32 or housing assemblies 40.

The entire mechanism is then covered with a resilient boot 36 or covering which will protect the user from the assembly.

As the users keep their hands on the hand grips 22 of the walker 10 and approaches stairs or other inclines, the users' fingers may be extended to engage the actuator bars 12 and 14 of either or both sides of the walker 10. By pulling slightly upward, the actuator bars 12 and 14 pull upward on the tabbed rings 32, which angles the tabbed rings 32 enough to compress the coiled spring 38. This movement allows the supplemental legs 24 to slide through the tabbed rings 32 until they rest onto the next available surface area. The washer 56 located on top of the supplemental leg 24 prevents the leg 24 from falling out of the existing frame 52 of the walker 10. When the actuator bars 12 and 14 are released, the tabbed rings 32, by means of the coiled springs 38, return to their original position and hold the supplemental legs 24 in place until the actuator bars 12 and 14 are engaged again.

Figure 7:
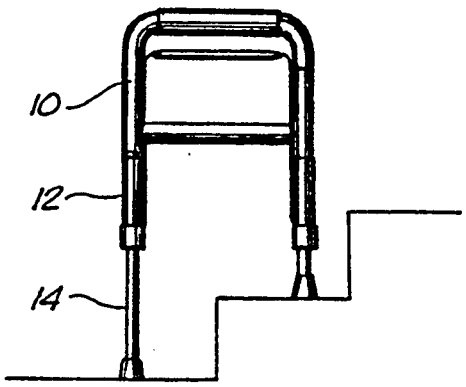
FIG. 7 is a fragmentary view of the second embodiment showing the modified actuator bars as attached to the housing assembly.
Figure 2:
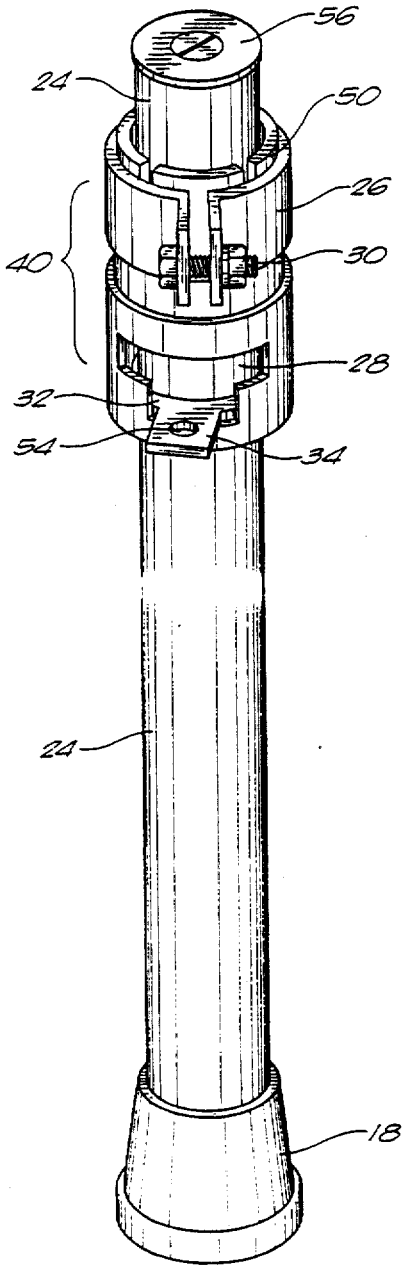
Figure 3:
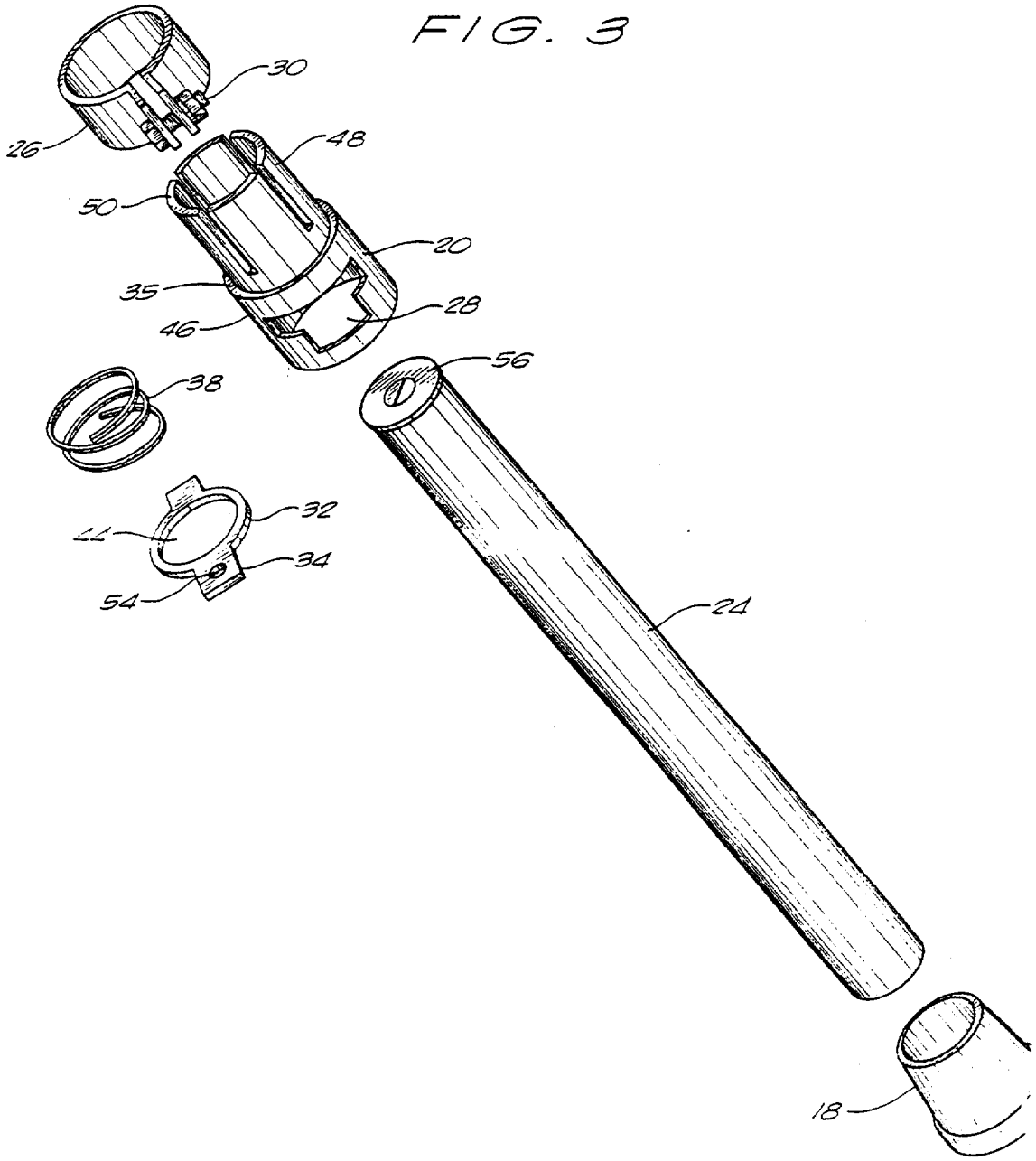
Figure 4:
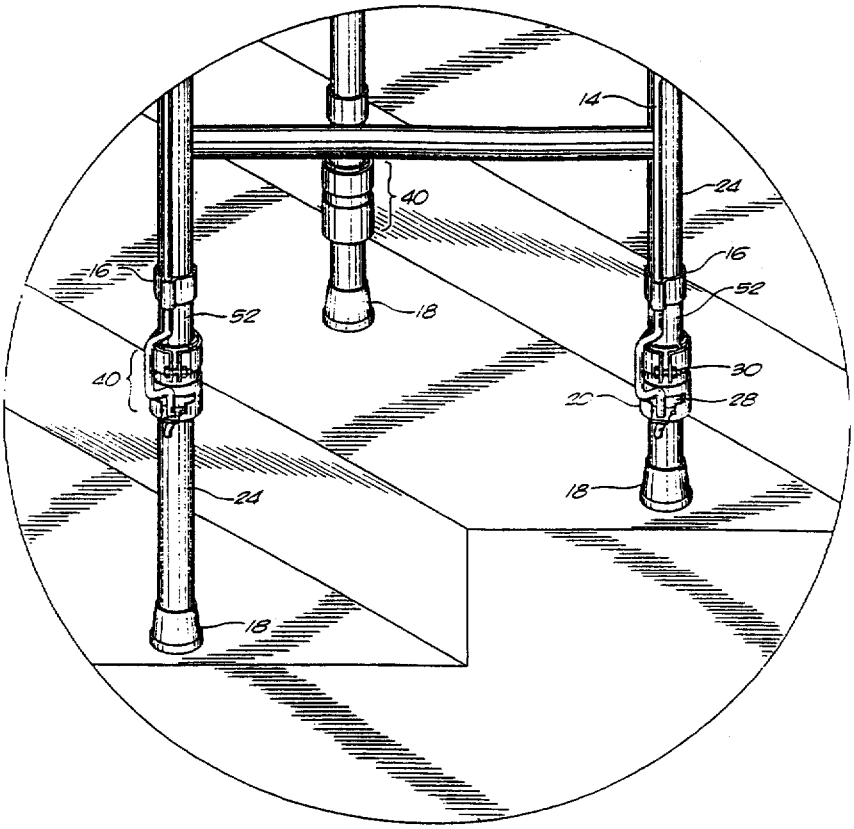
Figure 6:
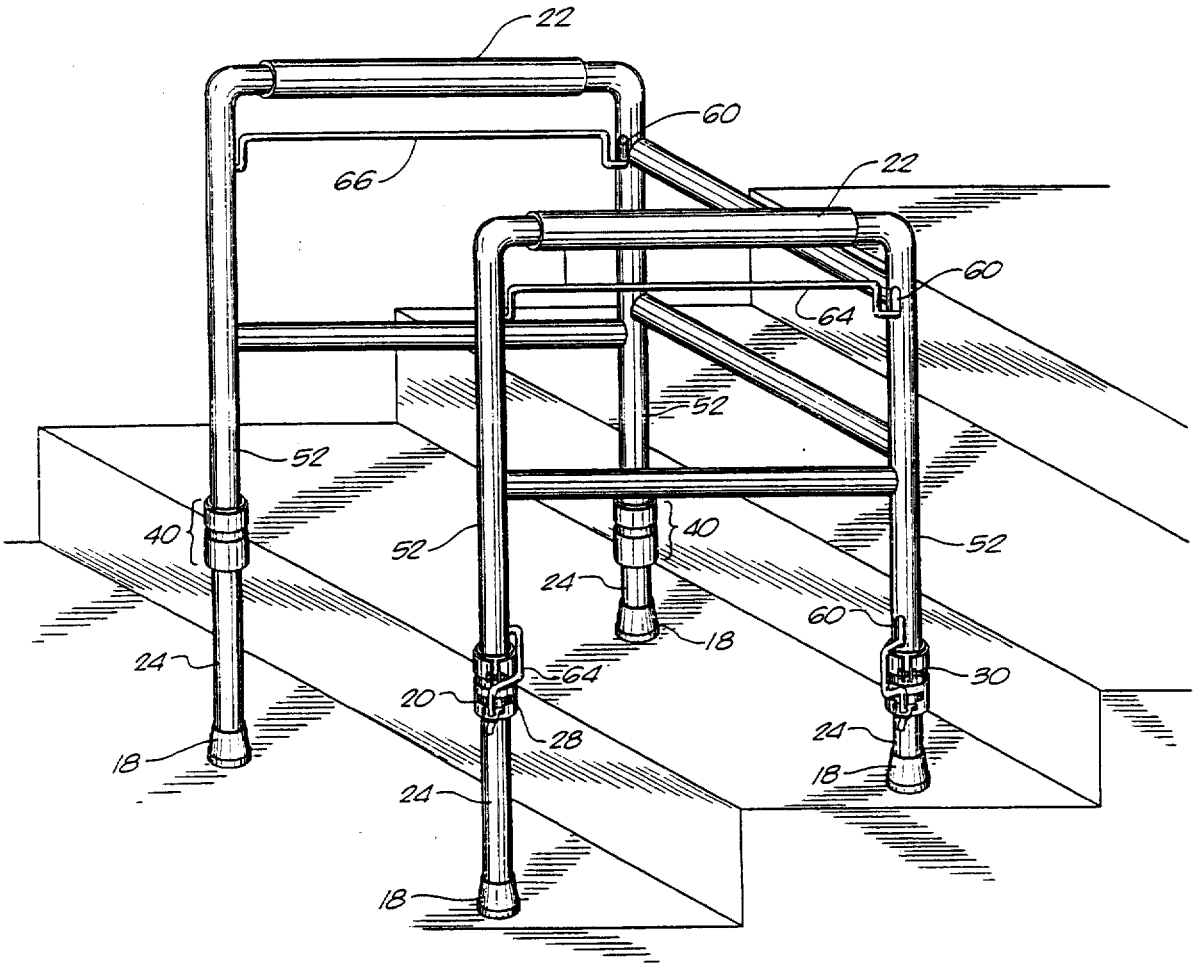
FIG. 6 illustrates another embodiment of the present invention with modified actuator bars concealed inside the walker frame.
Figure 7:
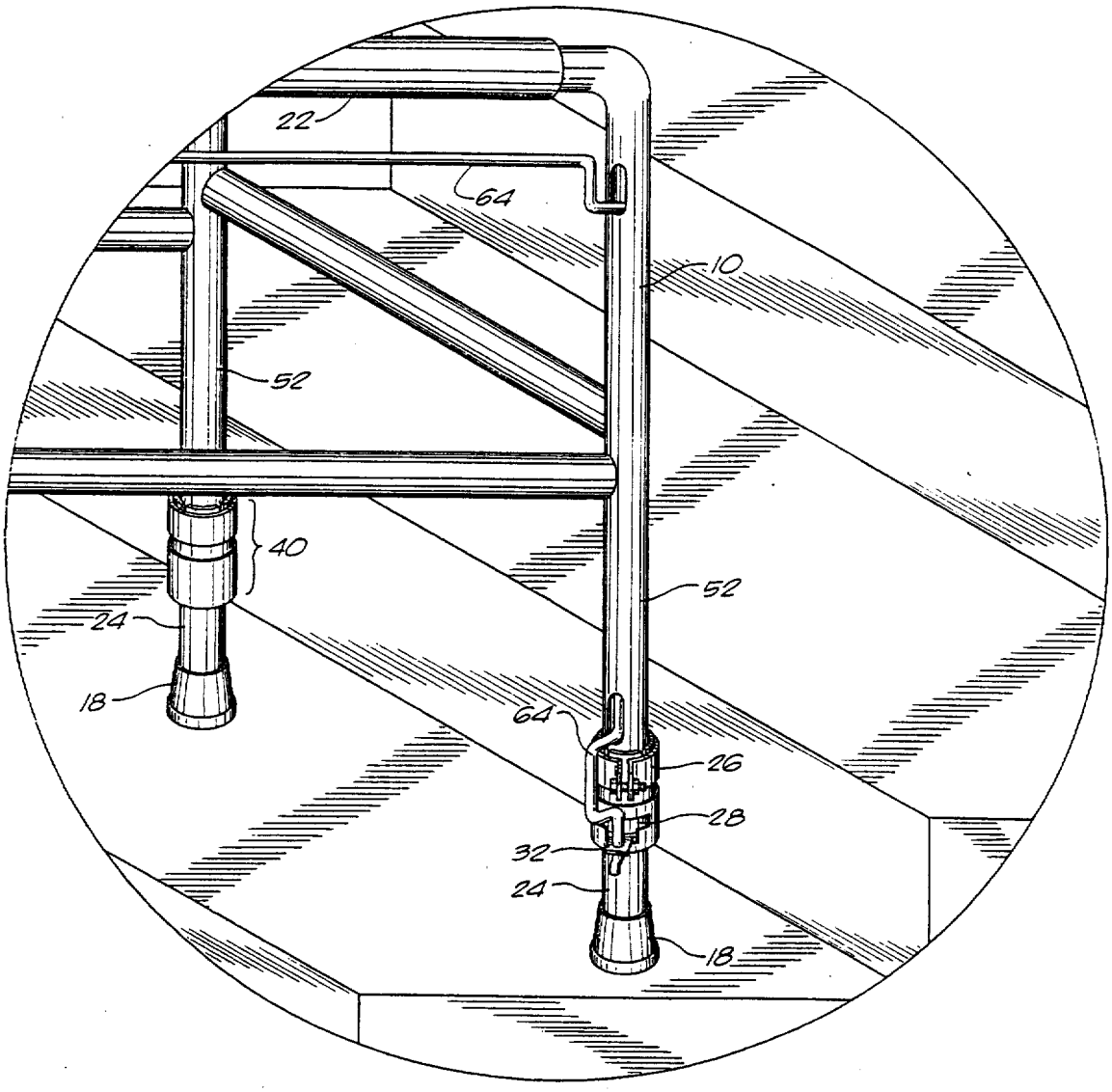

Another embodiment positions the mechanics as previously described, inside the walker frame 52. The basic design is relatively the same. Referring to FIGS. 6 and 7, the differences being that the existing walker frame 52 has been modified somewhat to receive a portion of the housing assembly 40 and the modified actuator bars 64 and 66. The front of the housing assembly 40 which includes the wide T-shaped opening 26 and tab 34 of the tabbed ring 32, remains visible on the outside of the walker frame 52. A longitudinal opening 60 is located in the upper portion of each frame 52 to receive the modified actuator bars 64 and 66.

Figure 5:
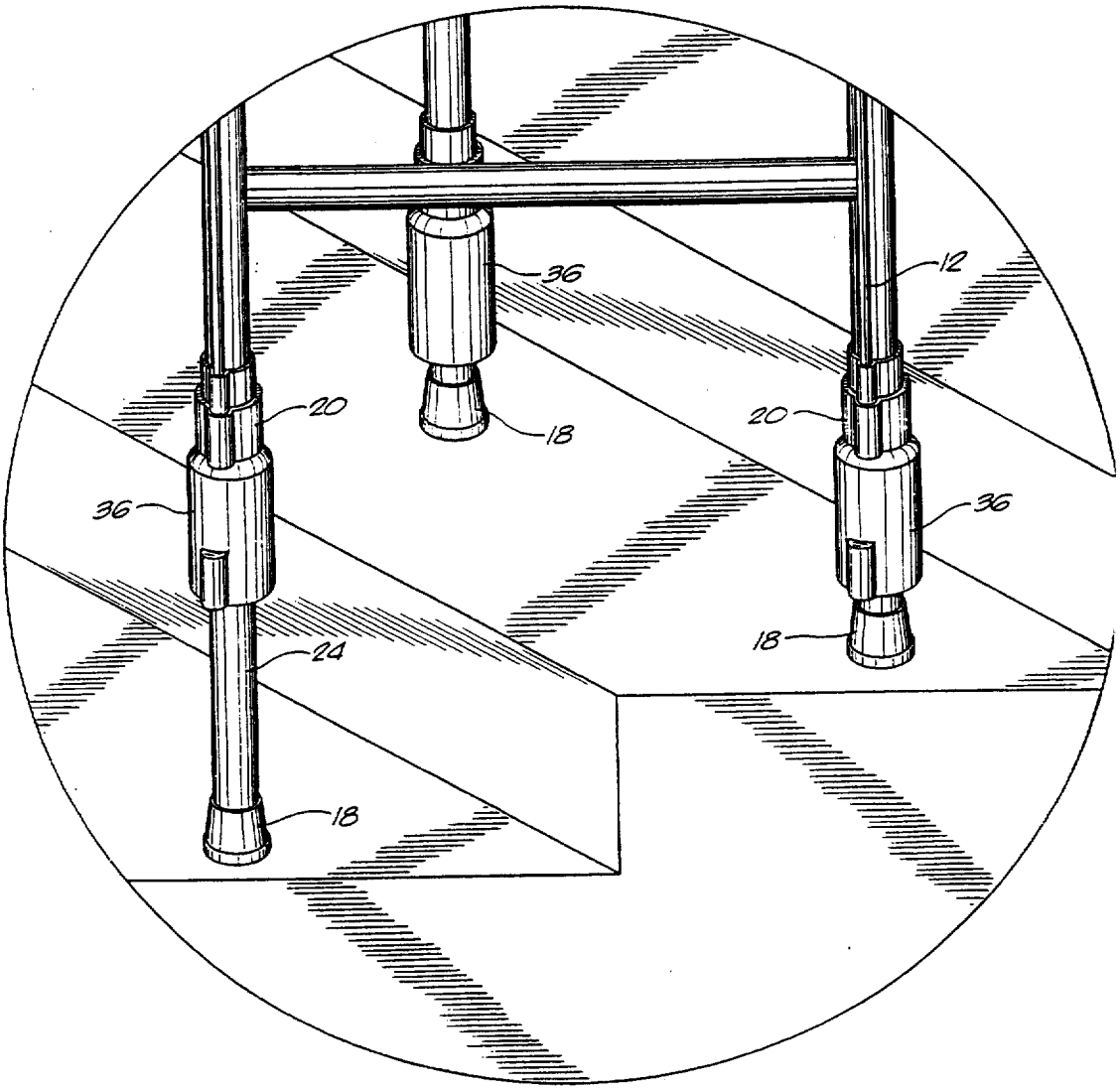
FIG. 5 illustrates the resilient boot or covering used to conceal the fusing assembly of the present invention.

The modified actuator bars 64 and 66 do not span the entire width of the side of the walker 10 in this embodiment. The modified actuator bars 64 and 66 designed to be parallel to the hand grips 22 and then turn downward on each side, perpendicular and then back to parallel; creating an L-shaped configuration on each side of the modified actuator bars 64 and 66. The modified actuator bars 64 and 66 then resume their original shape and extend downward, conforming to the shape of the walker 10. This design will enable the sides of the modified actuator bars 64 and 66 to be inserted into the longitudinal openings 60 in the side frames of the walker 10 and fed down to the housing assembly 40. The free ends of the modified actuator bars 64 and 66 are received and fastened into the housing assembly 40 as previously described. The exposed portion of the housing assembly 40 may be covered by a resilient boot or cover 36 for protection as shown in FIG. 5.

When the modified actuator bars 64 and 66 are engaged, they are allowed free movement up and down along the longitudinal opening 60. The mechanics of this embodiment work the same as in the first embodiment.

The foregoing description of the invention has been directed to a particular preferred embodiment of the present invention for purposes of explanation and illustration. It will be apparent to those skilled in the art that many modifications and changes in the adjustable walker attachment may be made without departing from the scope and spirit of the invention. It is, therefore, intended that the following claims cover such modifications and changes.

I claim:

1. A walker comprising:

a frame having a pair of hand grips formed thereon;

a plurality of legs connected to said frame and extending downwardly therefrom, said plurality of legs comprising four legs, each of said legs positioned at a corner of said frame;

a plurality of extensible leg portions slidably received by said plurality of legs and extending downwardly therefrom; and actuator means connected to said frame generally adjacent said hand grips, said actuator means interconnected to said legs and to said extensible leg portions for controlling a movement of said extensible leg portion with respect to said legs, said actuator means movable between a first position and a second position, said first position for causing said extensible leg portions to move freely with respect to said legs, said second position for causing said extensible leg portions to lock in position relative to said legs said actuator means comprising:

a first actuator bar extending between said first pair of legs on one side of said frame;

a second actuator means extending between said second pair of legs on another side of said frame, said first and second actuator bars positioned below said hand grips; and housing means interconnected to said first and second actuator bars and to said legs and to said extensible leg portions, said housing means for controlling the movement of said extensible leg portions with respect to said legs.

2. The walker of claim 1, each of said legs having a hollow tubular configuration, each of said legs opening at one end, said extensible leg portions received through said opening and slidable interior of said legs.

3. The walker of claim 1, said housing means comprising: a cylindrical sleeve extending around a portion of a leg and an extensible leg portion, said cylindrical sleeve rigidly affixed to said leg;

a ring member resiliently mounted within said cylindrical sleeve, said ring member having an open portion surrounding an exterior surface of said extensible leg portion, said ring member connected to one of said first and second actuator bars, a movement of one of said actuator bars causing said ring member to release said extensible leg portion for gravity-induced movement, and boot means for covering said housing means.

4. The walker of claim 3, said cylindrical sleeve having a T-shaped opening, said ring member having a tab extending outwardly through said T-shaped opening, one of said first and second actuator bars connected at one end to said tab.

5. The walker of claim 3, said cylindrical sleeve having a shoulder formed therein, said housing means further comprising:

a spring extending between said shoulder and said ring member so as to exert a resilient downward force on said ring member.

6. The walker of claim 3, each of said extensible leg portions having a stop formed at an end interior of said legs, said stop having a greater diameter than said open portion of said ring member, said stop for limiting the movement of said extensible leg portions with respect to said legs.

7. The walker of claim 3, said cylindrical sleeve having a plurality of longitudinal slits formed therein, said housing means further comprising:

a clamp extending around said longitudinal slits of said cylindrical sleeve, said clamp for affixing said cylindrical sleeve to an exterior surface of one of said legs.

8. The walker of claim 3, said boot means consisting of a resilient covering which encompasses the exterior of said housing means to conceal said housing means from sight.

9. A leg attachment for a walker of the type having a plurality of hollow tubular legs, said leg attachment comprising:

an extensible leg portion;

a housing means extending around an exterior of said extensible leg portion;

attachment means connected to said housing means for affixing said housing means to an exterior of said tubular leg; and actuator means interconnected to said housing means for controlling the movement of said extensible leg portion with respect to said housing means, said actuator means movable between a first position and a second position, said first position for causing said extensible leg portion to move freely, said second position for locking said extensible leg portion in a desired position, said housing means comprising:

a cylindrical sleeve extending around said extensible leg portion;

a ring member resiliently mounted within said cylindrical sleeve, said ring member having an open portion extending around an exterior surface of said extensible leg portion, said ring member connected to said actuator means, said actuator means causing a movement of said ring member so as to release said extensible leg portion for gravity-induced movement; and boot means for covering said housing means.

10. The leg attachment of claim 9, said extensible leg portion comprising a hollow tubular member having a stop formed on one end, said stop having a diameter greater than said hollow tubular member.

11. The leg attachment of claim 10, said extensible leg portion further comprising:

a rubber cap fastened to an end of said hollow tubular member opposite said stop, said rubber cap covering said end of said hollow tubular member.

12. The leg attachment of claim 9, said cylindrical sleeve having a T-shaped opening, said ring member having a tab extending outwardly through said T-shaped opening, said actuator means connected at one end to said tab.

13. The leg attachment of claim 12, said actuator means comprising:

an actuator bar connected to said ring member and extending upwardly therefrom, a movement of said actuator bar for causing said tab of said ring member to move within said T-shaped opening.

14. The leg attachment of claim 9, said cylindrical sleeve having a shoulder formed therein, said housing means further comprising:

a spring extending between said shoulder and said ring member so as to exert a resilient downward force on said ring member.

15. The leg attachment of claim 9, said cylindrical sleeve having a plurality of longitudinal slits formed therein, said attachment means comprising:

a clamp extending around said longitudinal slits of said cylindrical sleeve, said clamp for affixing said cylindrical sleeve to an exterior surface of one of the legs of the walker.

16. The leg attachment of claim 9, said boot means consisting of a resilient covering which encompasses the exterior portion of said housing means to conceal said housing means from sight.

17. The leg attachment of claim 16, said actuator bar comprising a generally U-shaped member having a height sufficient to position a portion of said actuator bar in proximity to a top of said walker.

18. The leg attachment of claim 16, further comprising:

a plurality of conforming bands extending around said actuator bar for allowing said actuator bar to be attached to the walker and for allowing said actuator bar to move relative to the walker.

* * * * *

UNITED STATES PATENT AND TRADEMARK OFFICE

CERTIFICATE OF CORRECTION

PATENT NO. : 5,349,977
DATED : September 27, 1994
INVENTOR(S) : Maurice S. Wood

It is certified that error appears in the above-identified patent and that said Letters Patent is hereby corrected as shown below:

The title page should be deleted to appear as per attached title page.
The sheets of drawings, consisting of figures 1-7, should be deleted to appear as per attached sheets.

Signed and Sealed this

Twenty-seventh Day of December, 1994

*Attest:*

Bruce Lehman

BRUCE LEHMAN

*Attesting Officer*

*Commissioner of Patents and Trademarks*

United States Patent [19]

Wood

[11] Patent Number: 5,349,977

[45] Date of Patent: Sep. 27, 1994

[54] ADJUSTABLE WALKER

[76] Inventor: Maurice S. Wood, 15318 Chipman, Houston, Tex. 77060

[21] Appl. No.: 680,843

[22] Filed: Apr. 5, 1991

[51] Int. Cl.[5] ..... A61H 3/00

[52] U.S. Cl. ..... 135/67; 135/69; 297/5; 248/410; 403/104; 403/109

[58] Field of Search ..... 135/67, 69, 70; 297/5, 297/345; 248/410, 188.5, 188.8; 403/104, 109, 107, 377

[56] References Cited

U.S. PATENT DOCUMENTS

| | | | |
|---|---|---|---|
| 1,372,456 | 3/1921 | Roetter | 248/410 |
| 2,090,550 | 8/1937 | Pilblad | 248/410 |
| 2,849,204 | 8/1958 | Petrick et al. | 248/410 |
| 3,176,700 | 4/1965 | Drury, Jr. | 135/69 X |
| 3,387,617 | 6/1968 | Reiber | 135/67 |
| 3,421,529 | 1/1969 | Vestal | 135/67 |
| 3,734,441 | 5/1973 | Lux | 248/410 X |
| 3,800,815 | 4/1974 | Birk | 135/67 |
| 4,411,283 | 10/1983 | Lucarelli | 135/67 |
| 4,777,973 | 10/1988 | Nakajima | 135/67 |
| 4,830,035 | 5/1989 | Liu . | |

FOREIGN PATENT DOCUMENTS

| | | | |
|---|---|---|---|
| 4761 | 10/1979 | European Pat. Off. | 135/69 |

*Primary Examiner*—David A. Scherbel
*Assistant Examiner*—Lan Mai
*Attorney, Agent, or Firm*—Harrison & Egbert

[57] ABSTRACT

The present invention relates to invalid walkers which are designed to aid the handicapped. Specifically, the present invention relates to an attachment to an existing walker, or a modified existing walker which is hand operated and designed to be made adjustable to accommodate inclines or stairs. This walking aid will enable persons using it to ascend and descend stairs and inclines much easier.

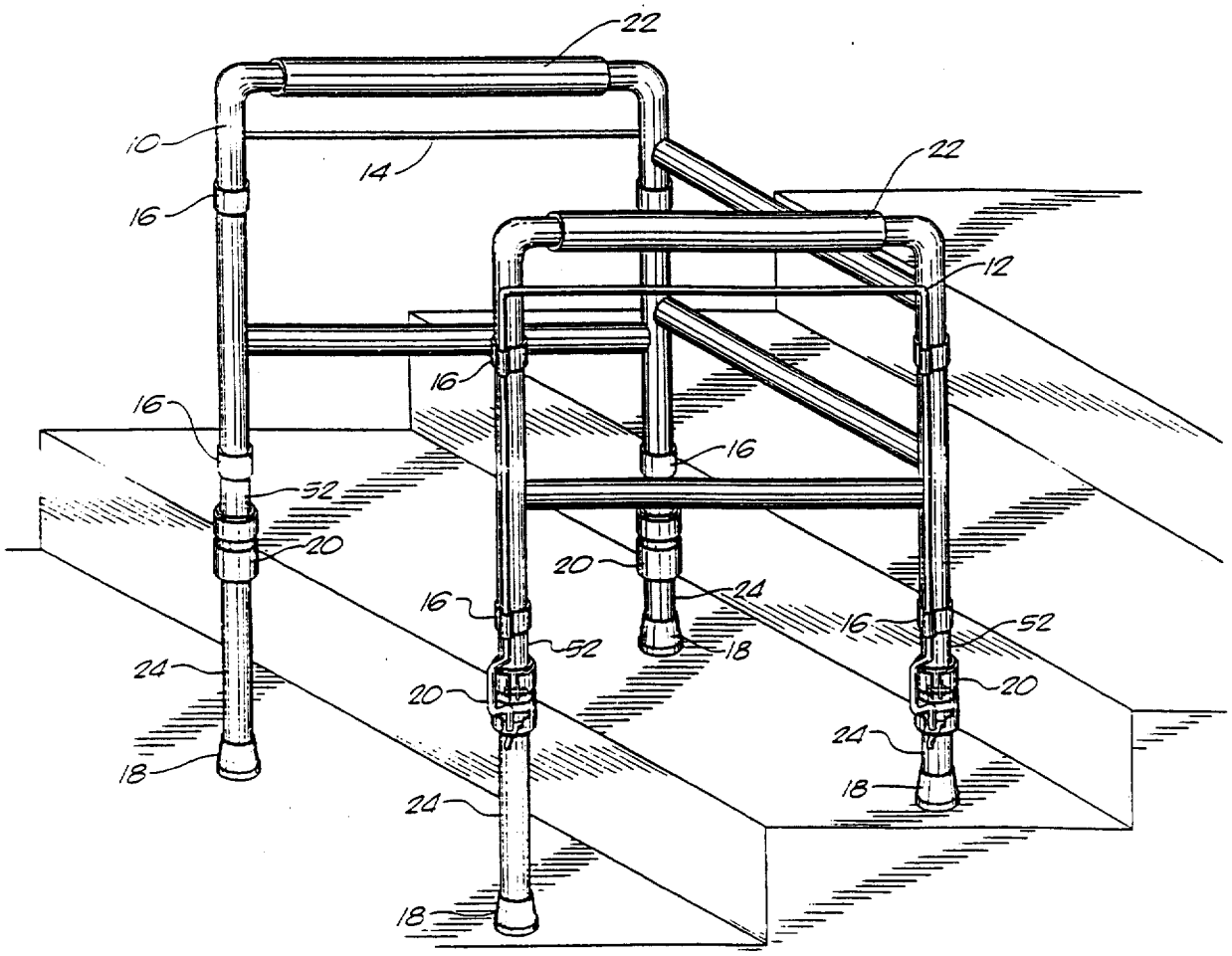

18 Claims, 6 Drawing Sheets